US008635721B2

(12) United States Patent
Zhang

(10) Patent No.: US 8,635,721 B2
(45) Date of Patent: Jan. 28, 2014

(54) PLAYARD

(75) Inventor: Da Liang Zhang, Hong Kong (HK)

(73) Assignee: BP Children's Products HK Co., Limited, Kwun Tong, Kowloon (HK)

( * ) Notice: Subject to any disclaimer, the term of this patent is extended or adjusted under 35 U.S.C. 154(b) by 434 days.

(21) Appl. No.: 12/987,168

(22) Filed: Jan. 10, 2011

(65) Prior Publication Data

US 2011/0284813 A1 Nov. 24, 2011

(30) Foreign Application Priority Data

May 21, 2010 (CN) ..... 2010 2 0201992 U

(51) Int. Cl.
*A47D 7/00* (2006.01)

(52) U.S. Cl.
USPC ..... 5/99.1; 5/98.1; 5/100; 256/25

(58) Field of Classification Search
USPC ..... 5/99.1, 98.1, 93.1, 97, 634, 655; 256/25
See application file for complete search history.

(56) References Cited

U.S. PATENT DOCUMENTS

| | | | | |
|---|---|---|---|---|
| 2,895,717 | A | 7/1959 | De Falco | |
| 6,859,957 | B1 | 3/2005 | Chen | |
| 6,954,949 | B1 | 10/2005 | Chen | |
| 7,568,242 | B2 * | 8/2009 | Troutman | 5/99.1 |
| 7,752,688 | B2 * | 7/2010 | Chen et al. | 5/93.1 |
| 2002/0005512 | A1 * | 1/2002 | Trill | 256/25 |
| 2006/0185082 | A1 | 8/2006 | Troutman | |
| 2006/0230528 | A1 * | 10/2006 | Church | 5/98.1 |
| 2011/0140061 | A1 * | 6/2011 | Cheng et al. | 256/25 |
| 2012/0216346 | A1 * | 8/2012 | Rampton et al. | 5/99.1 |

FOREIGN PATENT DOCUMENTS

| | | | |
|---|---|---|---|
| WO | 2008152530 | A1 | 12/2008 |

* cited by examiner

*Primary Examiner* — Peter M Cuomo
*Assistant Examiner* — Brittany Wilson
(74) *Attorney, Agent, or Firm* — Winston Hsu; Scott Margo

(57) ABSTRACT

A playard includes standing posts. The standing posts are substantially arranged in parallel, and a gap is formed between two adjacent standing posts. The playard further includes a pillar disposed between the two adjacent standing posts, and a width of the pillar is larger than the gap formed between the two adjacent standing posts. The playard further includes an enclosure connected to the pillar. Two ends of the enclosure are pulled along directions away from the two adjacent standing posts respectively so that the pillar is abutted on the two adjacent standing posts.

11 Claims, 6 Drawing Sheets

PLAYARD

BACKGROUND OF THE INVENTION

1. Field of the Invention

The present invention relates to a playard, and more particularly, to a playard for easily assembling an enclosure.

2. Description of the Prior Art

A conventional playard is often foldable and is assembled by a plurality of tubes and enclosures. The playard can be folded to a smaller volume by folding mechanisms between the tubes and pivotal junctions so as to be carried or stored easily when the playard is not in use.

For protecting the playard and having better air permeability as well as adjusting light so as to provide a comfortable space inside the playard, the conventional playard is covered by a net-shaped or a cotton-made enclosure and a soft cushion is paved on a bottom of frame. However, the enclosure of the conventional playard is fixed on a standing post of the frame by screws or other fixing manner. For example, the enclosure disclosed in U.S. Pat. No. 6,954,949 is abutted between two adjacent standing posts arranged in front-to-rear position, and the enclosure disclosed in U.S. Pat. No. 6,859,957 is disposed in a gap between the engaged two adjacent standing posts. The enclosure is not easy to be assembled or taken apart from the frame for such kinds of fixing manners. On the other hand, the enclosure of the conventional playard is fixed on the frame by screws securing at a point. So, it often stretches the enclosure when using, folding or expanding the playard, so that a fixing junction between the enclosure and the frame is easily broken due to the stretching.

SUMMARY OF THE INVENTION

The present invention provides a playard for easily assembling an enclosure for solving above drawbacks.

According to the claimed invention, a playard of the present invention includes a plurality of standing posts. Each two of the plurality of standing posts are adjacent in pair, the plurality of standing posts are substantially arranged in parallel, and a gap is formed between two adjacent standing posts. The playard further includes a pillar disposed between the two adjacent standing posts and an enclosure connected to the pillar. A width of the pillar is larger than the gap, and the pillar is abutted on the two adjacent standing posts when the enclosure fences a space for the playard.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
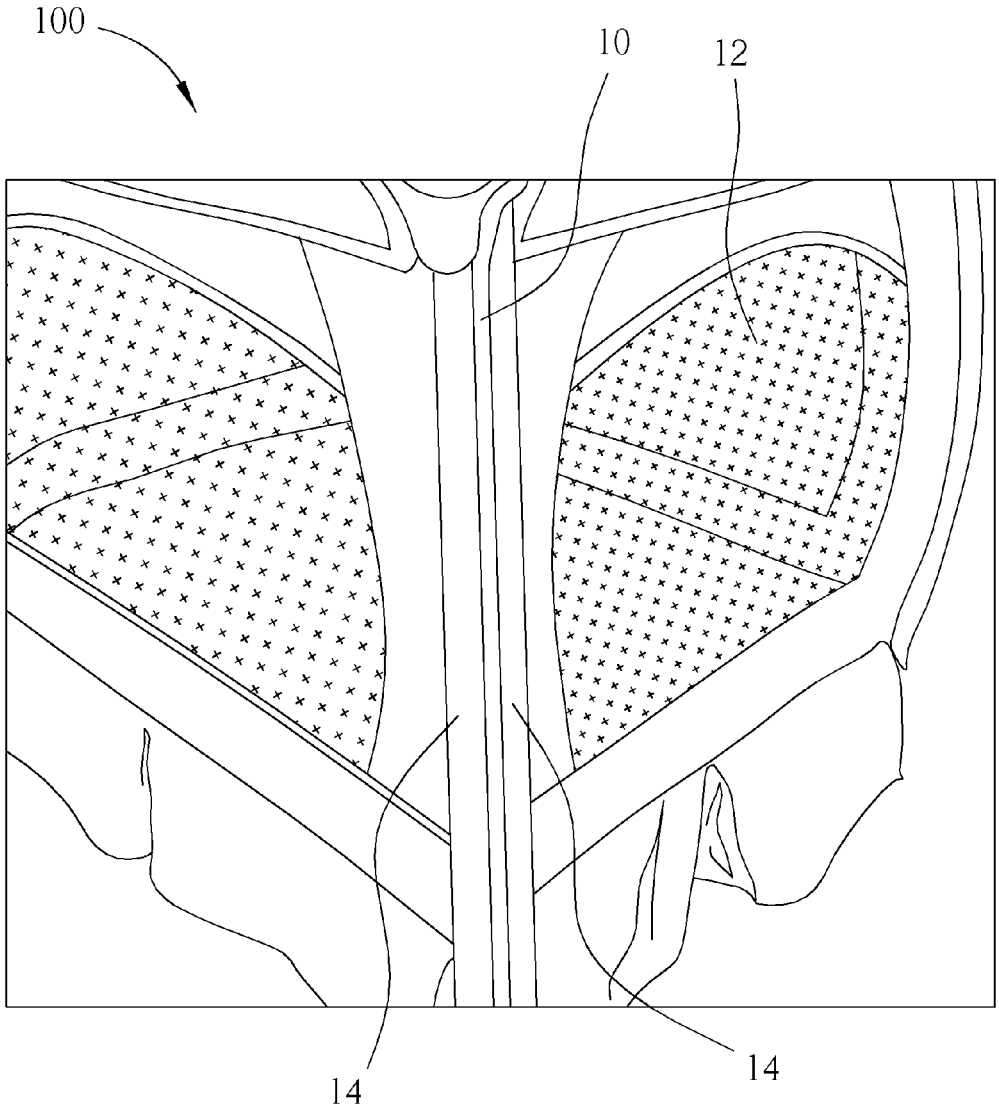
FIG. 1 is a schematic diagram of a playard of the present invention.
Figure 2:
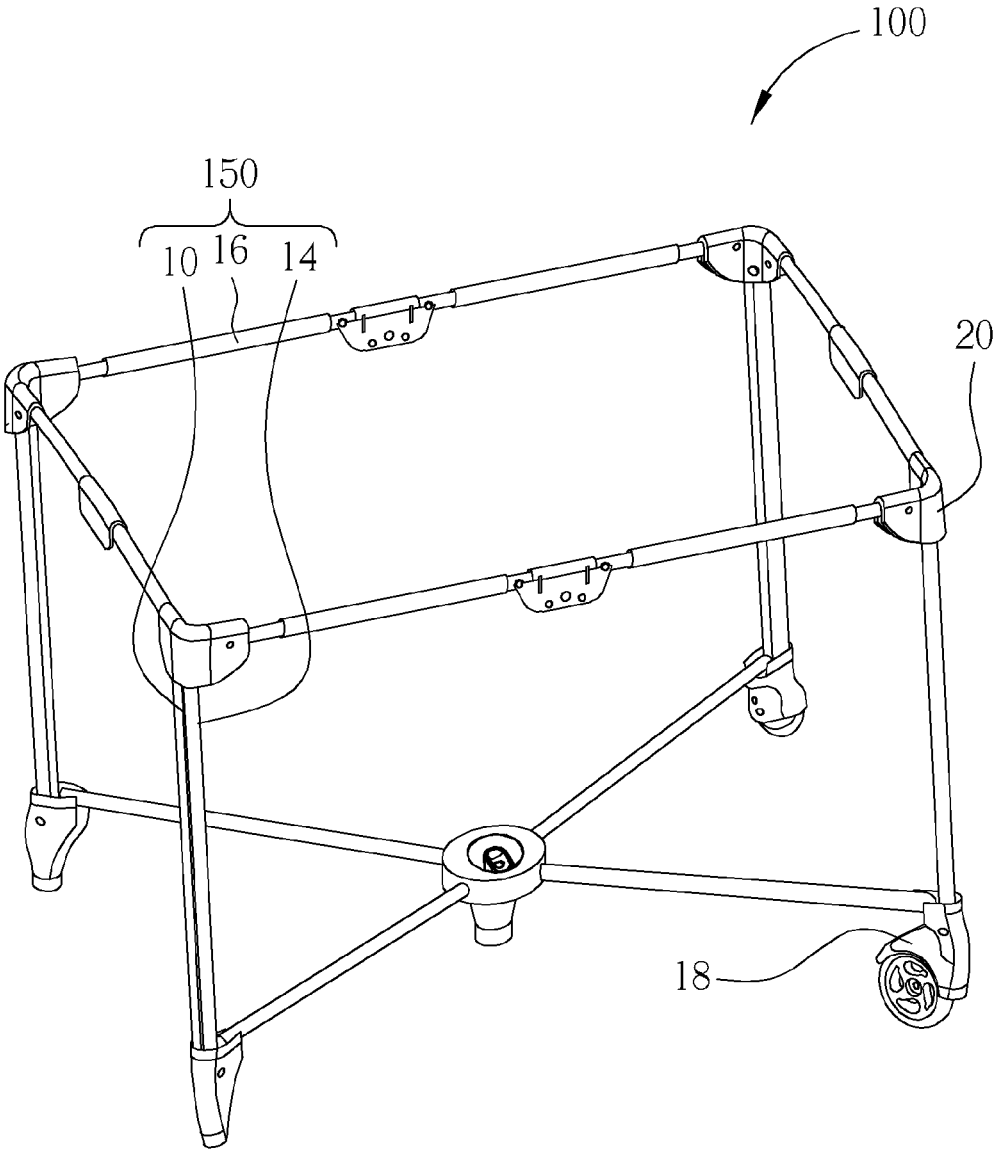
FIG. 2 is a schematic diagram of the playard without an enclosure of the present invention.

Please refer to FIG. 1. FIG. 1 is a schematic diagram of a playard 100 of the present invention. The playard 100 includes a plurality of standing posts 14. Each two of the plurality of standing posts 14 are adjacent in pair, the plurality of standing posts 14 are substantially arranged in parallel, and a gap is formed between two adjacent standing posts 14. The playard 100 includes a pillar 10 disposed between the two adjacent standing posts 14 and an enclosure 12 connected to the pillar 10. A width of the pillar 10 is larger than the gap. Two ends of the enclosure 12 pass through the gap and are pulled along a direction away from the two adjacent standing posts 14, so that the pillar 10 can be abutted by the two adjacent standing posts 14 when the enclosures 12 enclose the playard 100 to form a space for a child to rest or play inside. Please refer to FIG. 2. FIG. 2 is a schematic diagram of the playard 100 without the enclosure 12 of the present invention. As shown in FIG. 2, the playard 100 further includes a plurality of handrail tubes 16 and a plurality of foot stands 18. Each of the foot stands 18 sheathes bottom ends of the two adjacent standing posts 14 and the pillar 10 so as to fix a relative position of the two adjacent standing posts 14 and the pillar 10. The playard 100 further includes a plurality of corner junctions 20. Each of the corner junctions 20 is installed on top ends of the two adjacent standing posts 14 and the pillar 10 for connecting the two adjacent standing posts 14, the pillar 10, and the plurality of handrail tubes 16, so that the plurality of standing posts 14, the pillar 10, and the plurality of handrail tubes 16 can form a supporting frame 150. A number of the standing posts 14, the pillar 10, the foot stands 18, and the corner junction 20 assembled in the playard 100 can be determined according to the practical application.

The enclosure 12 is connected to a radial surface of the pillar 10 (a cylindrical surface of the pillar 10), and the pillar 10 can be a cylinder with any arc angle and can be flexible. Two adjacent standing posts 14 can be arranged in parallel, and an arc angle and a length of the standing post 14 can be similar to the pillar 10, that is, the two adjacent standing posts 14 and the pillar 10 are parallel to one another. The foot stand 18 is a close-end part with an opening opened upward. The foot stand 18 is installed on bottom ends of the two adjacent standing posts 14, and the corner junction 20 is installed on top ends of the two adjacent standing posts 14. Accordingly, the foot stand 18 and the corner junction 20 can fix positions of the two adjacent standing posts 14 and the gap, and the foot stands 18 the corner junctions 20 connect the plurality of handrail tubes 16 and standing posts 14 to form the supporting frame 150 of the playard 100. Furthermore, the gap between the two adjacent standing posts 14 is smaller than a maximum width of the pillar 10, and is larger than a maximum thickness of the enclosure 12. The pillar 10 can be a circular rod as well as a polygonal rod. The two adjacent standing posts 14 can be a hollow rod, and each of the plurality of handrail tubes 16 can be a foldable rod which can be rotated relative to the corner junction 20.

The pillar 10 can be substantially made of a hollow or a solid plastic or metal material to provide a support for the enclosure 12 being abutted on the two adjacent standing posts 14. The two adjacent standing posts 14 can be substantially made of a hollow or a solid plastic or metal material. The enclosure 12 can substantially be a transparent or nontransparent braiding part. When the enclosure 12 is connected to the radial surface of the pillar 10, another side of the enclosure 12 not connected to the pillar 10 can pass through the gap formed between the two adjacent standing posts 14. The enclosure 12 of passing through the gap has two portions, and the two portions of the enclosure 12 are pulled and abutted on the two adjacent standing posts 14 along different directions respectively. Accordingly, the enclosure 12 connected to the pillar 10 can be supported by the two adjacent standing posts 14 along force application directions, and the pillar 10 can be supported by the two adjacent standing posts 14 so as to fix the relative position of the two adjacent standing posts 14 and the pillar 10 as well as to fix the enclosure 12 to the playard 100. The enclosure 12 can be attached to the pillar 10, be sewed to the pillar 10, or sheathe on the pillar 10.

Figure 3:
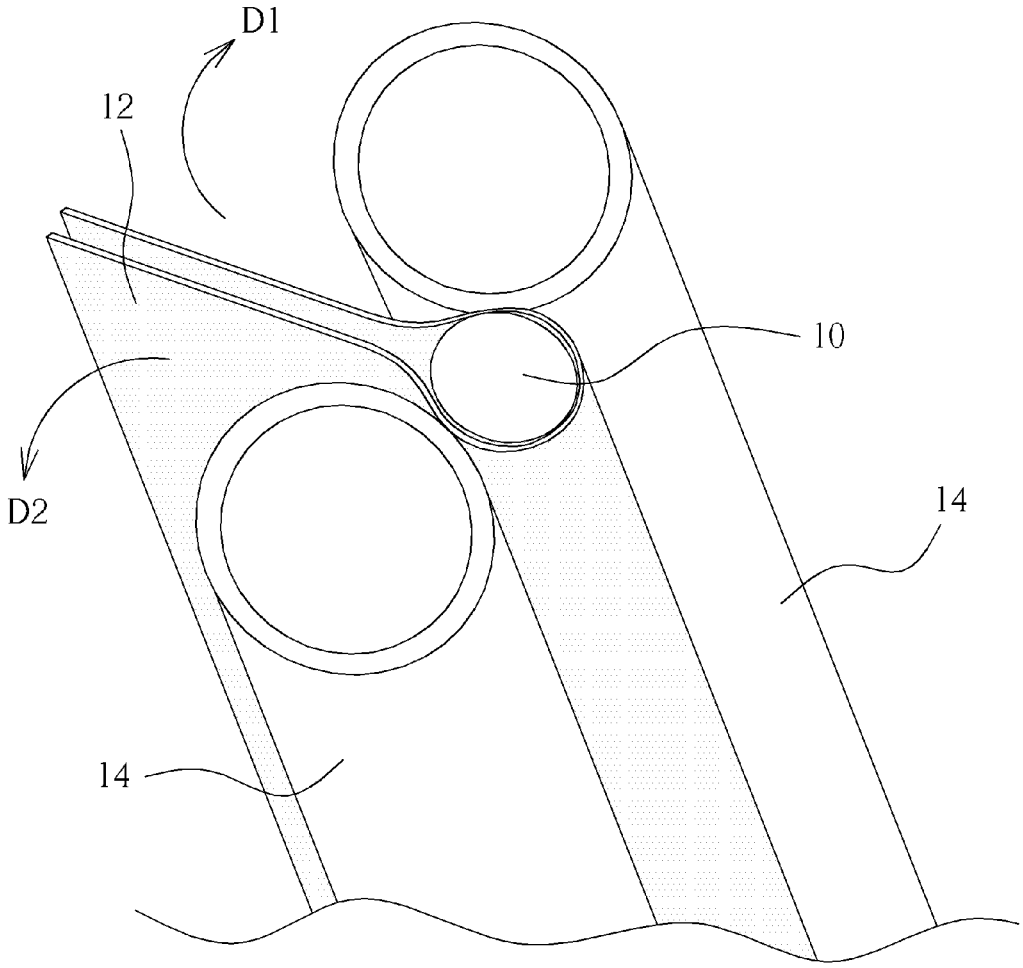
FIG. 3 is a schematic diagram of a pillar abutted and supported on two adjacent standing posts according to a first embodiment of the present invention.

Please refer to FIG. 3. FIG. 3 is a schematic diagram of the pillar 10 abutted and supported on the two adjacent standing posts 14 according to a first embodiment of the present invention. The enclosure 12 is movably connected to the radial surface of the pillar 10. In other words, the pillar 10 is connected to the enclosure 12 in a replaceable manner, such as enveloping, sheathing and so on. When the two ends of the enclosure 12 pass through the gap between the two adjacent standing posts 14 and depart away along a direction of D1 and a direction of D2. Part of the enclosure 12 constrained on another side of the two adjacent standing posts 14 by the pillar 10 can not pass through the gap between the two adjacent standing posts 14 due to the gap between the two adjacent standing posts 14 being smaller than the width of the pillar 10 and being larger than the maximum thickness of the enclosure 12. Accordingly, the enclosure 12 can be pulled along the directions of D1 and D2, so that the pillar 10 is supported by the two adjacent standing posts 14 so as to fix the relative position of the pillar 10 and the two adjacent standing posts 14. Furthermore, it can fix a position of the enclosure 12 to prevent from moving by the pillar 10 being supported by the two adjacent standing posts 14.

Figure 4:
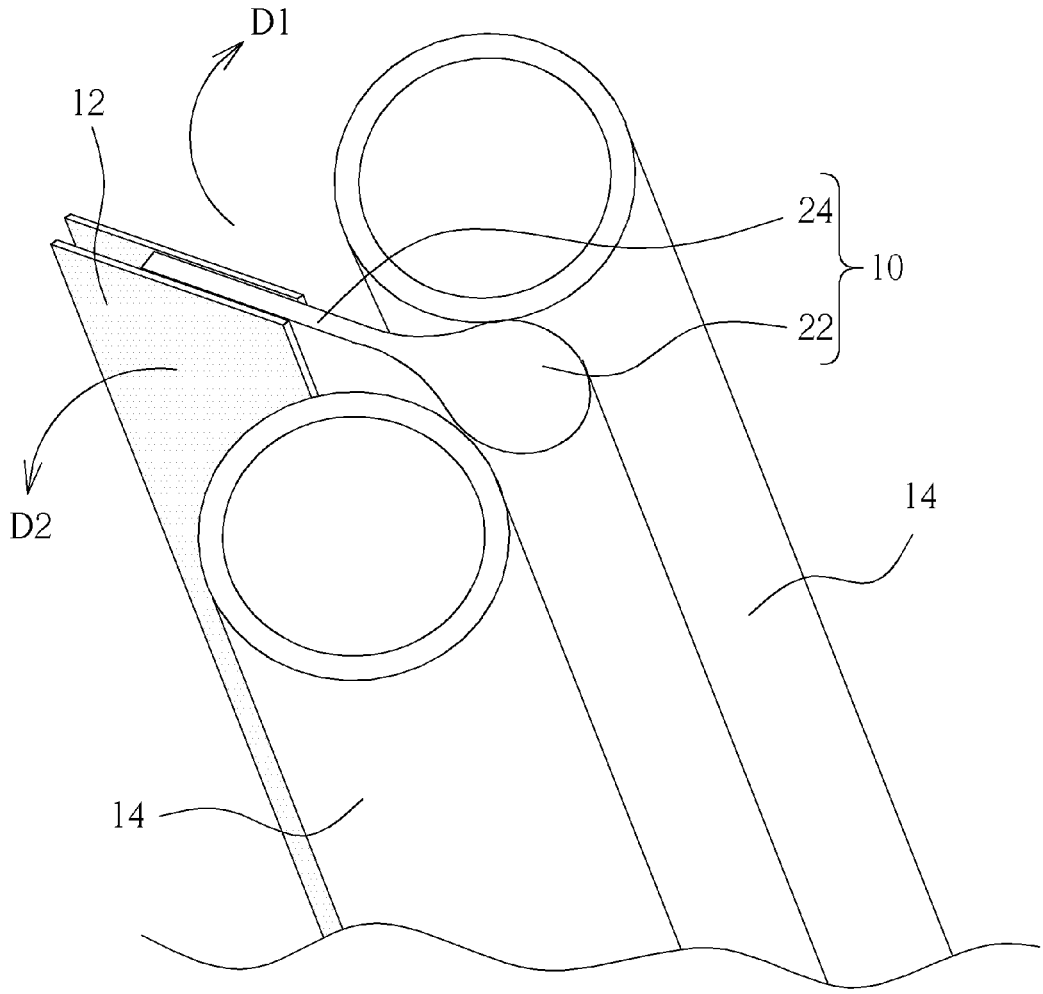
FIG. 4 is a schematic diagram of the pillar supported on the two adjacent standing posts according to a second embodiment of the present invention.

Please refer to FIG. 4. FIG. 4 is a schematic diagram the pillar 10 supported on the two adjacent standing posts 14 according to a second embodiment of the present invention. In this embodiment, the pillar 10 includes a cylindrical structure 22 and an extending structure 24 extending from the cylindrical structure 22 and passing through the gap between the two adjacent standing posts 14. The enclosure 12 is connected to both sides of the extending structure 24 respectively. The gap between the two adjacent standing posts 14 is larger than a thickness of the extending structure 24. In this embodiment, the cylindrical structure 22 and the extending structure 24 can be monolithically integrated, and the extending structure 24 can be portion of the pillar 10 protruding from a radial surface of the cylindrical surface 22. The extending structure 24 not only can be a continuous body with the cylindrical structure 22 but also can be an independent part connected to the radial surface of the cylindrical structure 22 by attaching, locking, sheathing, engaging, and so on. The enclosure 12 can be connected to the two sides of the extending structure 24 by attaching, sewing and so on, or pass through a hole on the extending structure 24. The gap of the two adjacent standing posts 14 is smaller than the maximum width of the pillar 10 and is larger than a sum of a maximum thickness of the extending structure 24 and a maximum thickness of the enclosure 12. Accordingly, when a side of the enclosure 12 connected to the extending structure 24 passes through the gap between the two adjacent standing posts 14 and is located on another side of the two adjacent standing posts 14 opposite to the cylindrical structure 22, and is pulled along the directions of D1 and D2, the pillar 10 can not pass through the gap between the two adjacent standing posts 14 due to the gap between the two adjacent standing posts 14 being smaller than the width of the pillar 10, so that the pillar 10 is supported by the two adjacent standing posts 14, so as to fix a relative position of the pillar 10 and the two adjacent standing posts 14.

Figure 5:
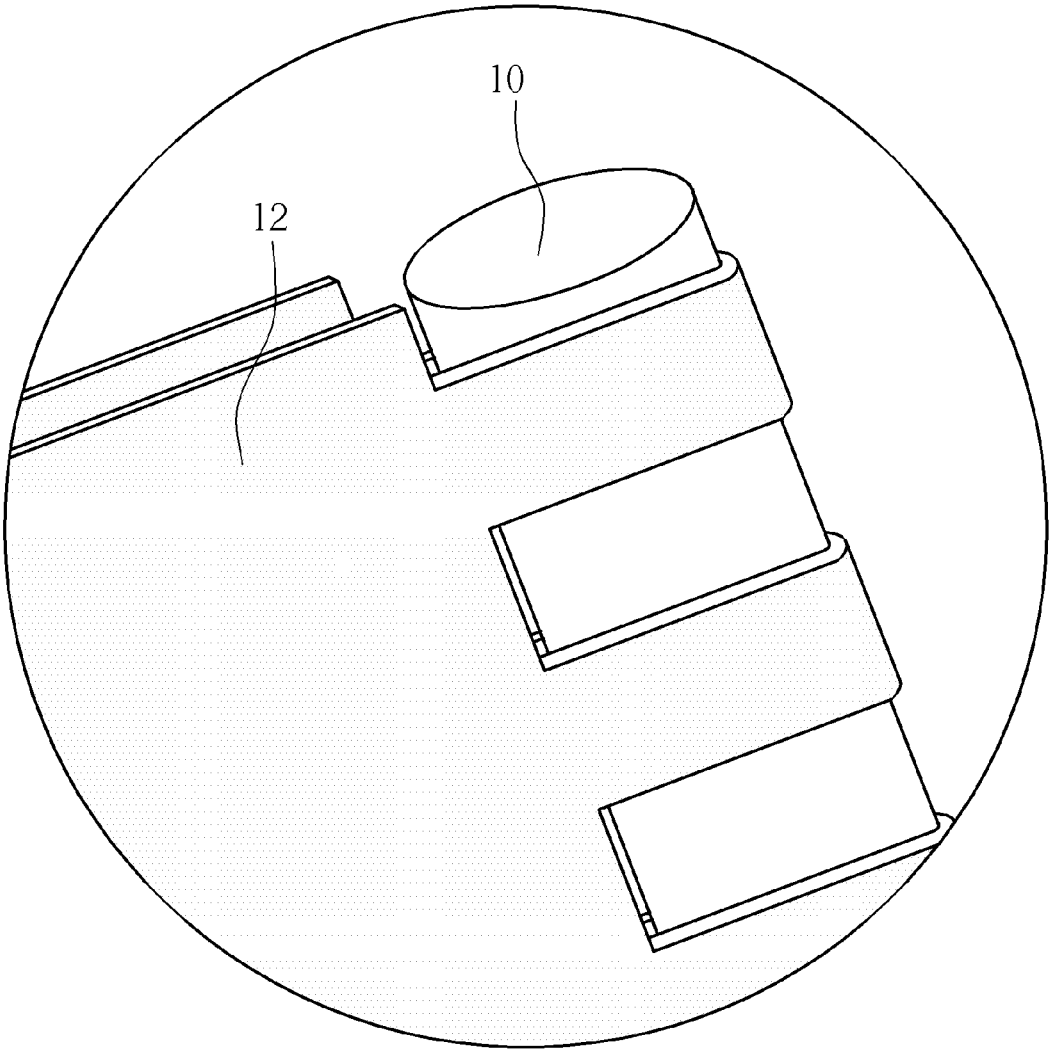
FIG. 5 is a schematic diagram of the enclosure enveloped on a radial surface of the pillar by partially connection according to a third embodiment of the present invention.
Figure 6:
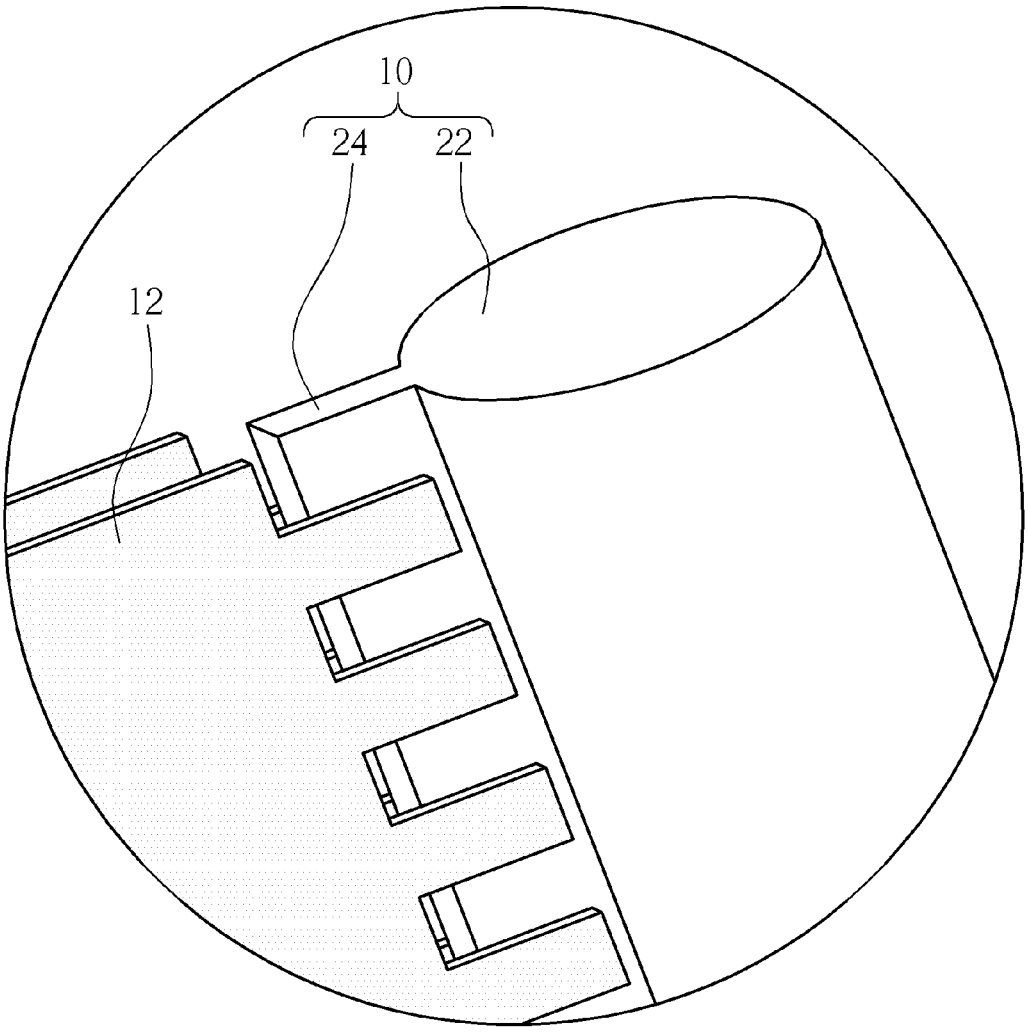
FIG. 6 is a schematic diagram of the enclosure fixed on both sides of an extending structure by partially connection according to a fourth embodiment of the present invention.

The pillar 10 and the two adjacent standing posts 14 are not limited to the cylindrical structures 22 as mentioned in the aforesaid embodiment. They can be columns with polygon cross-section or with surfaces fitting with each other, so as to have a different visual effect due to different shapes and to have a different application due to different functions. Furthermore, the connecting method between the enclosure 12 and the pillar 10 is not limited to the connecting method mentioned in the aforesaid embodiment, the enclosure 12 can be enveloped on the radial surface of the pillar 10 by partial connection, or can be fixed on both sides of the extending structure 24 by partial connection. Please refer to FIG. 5 and FIG. 6. FIG. 5 is a schematic diagram of the enclosure 12 enveloped on the radial surface of the pillar 10 by partially connection according to a third embodiment of the present invention. FIG. 6 is a schematic diagram of the enclosure 12 fixed on the both sides of the extending structure 24 by partially connection according to a fourth embodiment of the present invention. Working principles are the same as those in the aforesaid embodiment, so they will not be depicted herein.

Compared to the prior art, the playard of the present invention has a structure for easy assembly. The pillar connected to the enclosure can be movably supported by the two adjacent standing posts by applying a pulling force. Furthermore, the top end and the bottom end of the two adjacent standing posts are disposed in the corner junction and the foot stand, so that the relative position of the two adjacent standing posts and the gap can keep stable. Furthermore, the plurality of the handrail tubes is installed inside the corner junction to form a supporting frame for easy assembly. The present invention is not only to simply the assembly process in the prior art, but also allow the playard to have a various shape due to the enclosure being enveloped partially or fully on the pillar and due to a structural design of the standing posts being exposed outside.

Those skilled in the art will readily observe that numerous modifications and alterations of the device and method may be made while retaining the teachings of the invention.

What is claimed is:

1. A playard, comprising:

a plurality of standing posts, each two of the plurality of standing posts being spaced apart and adjacent in pair, the plurality of standing posts being substantially arranged in parallel, and a gap being formed between two adjacent standing posts;

a pillar disposed between the two adjacent standing posts, a width of the pillar being larger than the gap; and an enclosure connected to the pillar wherein the pillar is abutted on the two adjacent standing posts when the enclosure fences a space for the playard.

2. The playard of claim 1, wherein two ends of the enclosure are pulled along a direction away from the two adjacent standing posts respectively so that the pillar is abutted on the two adjacent standing posts.

3. The playard of claim 1, wherein the enclosure envelops a surface in radial direction of the pillar.

4. The playard of claim 1, wherein the enclosure sheathes the pillar.

5. The playard of claim 1, wherein the pillar further comprises:

a cylindrical structure; and an extending structure connected to the cylindrical structure and passed through the gap of the two adjacent standing posts.

6. The playard of claim 5, wherein two ends of the enclosure are connected to the extending structure respectively.

7. The playard of claim 5, wherein the gap between the two adjacent standing posts is larger than a thickness of the extending structure.

8. The playard of claim 5, wherein the cylindrical structure and the extending structure are monolithically integrated.

9. The playard of claim 1, further comprising:

a plurality of handrail tubes;

a foot stand sheathing bottom ends of the two adjacent standing posts and the pillar so as to fix a relative position of the two adjacent standing posts and the pillar; and a corner junction installed on top ends of the two adjacent standing posts and the pillar for connecting the two adjacent standing posts, the pillar and the plurality of handrail tubes, wherein the foot stand and the corner junction connect with the handrail tubes and standing posts to form a supporting frame of the playard.

10. The playard of claim 9, wherein a bottom end of the pillar is enveloped in the enclosure, and the foot stand sheathes a portion of the enclosure so as to fix the two adjacent standing posts, the pillar and the enclosure.

11. The playard of claim 1, wherein the enclosure is sewed to the pillar.

* * * * *